US008393504B2

(12) United States Patent
Scott

(10) Patent No.: US 8,393,504 B2
(45) Date of Patent: Mar. 12, 2013

(54) RIFLE OR GUN SLING SYSTEM

(76) Inventor: Barry Scott, Corona, CA (US)

( * ) Notice: Subject to any disclaimer, the term of this patent is extended or adjusted under 35 U.S.C. 154(b) by 464 days.

(21) Appl. No.: 12/684,610

(22) Filed: Jan. 8, 2010

(65) Prior Publication Data

US 2011/0168747 A1 Jul. 14, 2011

(51) Int. Cl.
*F41C 23/02* (2006.01)

(52) U.S. Cl. ..... 224/149; 224/150; 224/913

(58) Field of Classification Search ..... 224/149, 224/150, 913, 917, 219, 220, 222, 236, 239, 224/250, 267; 42/85; D3/262
See application file for complete search history.

(56) References Cited

U.S. PATENT DOCUMENTS 2,576,559 A 9/1948 Bennek
4,098,441 A 7/1978 Campbell
4,299,343 A * 11/1981 Atchisson ..... 224/149
5,121,564 A 6/1992 Story
5,265,365 A * 11/1993 Finn ..... 42/74
6,176,407 B1 * 1/2001 Jones et al. ..... 224/584
6,523,180 B1 * 2/2003 Christopher ..... 2/59
6,874,618 B1 4/2005 Cragg
7,540,107 B2 6/2009 Oum

* cited by examiner

*Primary Examiner* — Justin Larson
*Assistant Examiner* — Adam Waggenspack
(74) *Attorney, Agent, or Firm* — Kenneth L. Green

(57) ABSTRACT

A sling is held in a folded state under a cheek piece attached to the butt of a rifle or gun stock, and deployed by drawing from the cheek piece and attaching to a forward end of the rifle or gun. A rear sling end may remain attached to the rear of the rifle or gun at all times. The folded sling is stowed in a channel formed beneath the cheek piece by a releaseable flap, with a forward sling end exposed at the rear of the channel. The sling is deployed by drawing from the rear of the channel and then reaching forward to attach to the forward end of the rifle or gun. The sling may be returned to the folded state by folding the sling, releasing one side of the flap, placing the folded sling under the cheek piece, and reattaching the flap.

19 Claims, 5 Drawing Sheets

RIFLE OR GUN SLING SYSTEM

BACKGROUND OF THE INVENTION

The present invention relates to rifle and shotgun slings and in particular to a convenient sling storage and deployment system.

Rifles and shotguns are often carried on hunting trips. In some instances a hunter may prefer to simply carry the rifle or shotgun by grasping a central point, and in other instances, may prefer to carry the rifle or shotgun using a sling attached to the rifle or shotgun. Unfortunately, when the sling is not in use, it may snag on shrubs or other vegetation, or on a fence or other artificial object encountered by the hunter.

Quick attach slings are known, for example, in U.S. Pat. No. 4,098,441 for "Quick-Attach, Universal Gun Sling" discloses a sling with one end which slips over the butt of the stock and an opposite end which slips over the barrel. While the '441 patent provides a partial solution, the hunter must carry the sling and attach both ends before use. Such carrying and attaching is awkward in many of the situations a hunter encounters and attempting to keep one end of the sling attached while attaching the opposite end may prove difficult, especially in low light environments. A need thus remains for an easily carried and attached gun sling.

BRIEF SUMMARY OF THE INVENTION

The present invention addresses the above and other needs by providing a sling which is held in a folded state under a cheek piece attached to the butt of a rifle or gun stock, and deployed by drawing from the cheek piece and attaching to a forward end of the rifle or gun. A rear sling end may remain attached to the rear of the rifle or gun at all times. The folded sling is held in a channel formed beneath the cheek piece by a releaseable flap, with a forward sling end exposed at the rear of the channel. The sling is deployed by drawing from the rear of the channel and then reaching forward to attach to the forward end of the rifle or gun. The sling may be returned to the folded state by folding the sling, releasing one side of the flap, placing the folded sling under the cheek piece, and reattaching the flap.

In accordance with one aspect of the invention, there is provided a long gun and sling system. The long gun includes a front gun portion including a barrel, a center gun portion including a receiver, a rear gun portion including a butt, and a stock forming the butt. The sling system includes a sling and a cheek piece. The cheek piece is made from a loop compatible stretch fabric and wrapped around the butt of the long gun and includes an overlapping portion with loop fastening material attached for cooperating with the loop compatible stretch fabric for holding the cheek piece around the butt of the long gun. A non-slip panel on an interior surface of the cheek piece resides against the stock to resist slippage of the cheek piece on the stock. A flap is attached along a first side of the cheek piece, reaches under the cheek piece, and is releaseably attached on an opposite side of the cheek piece, forming a channel, having an open rearward end, under the cheek piece. The sling has a rearward sling end attached to the butt of the stock and resides in a folded state and in a deployed state. In the folded state the sling is folded multiple overlapping times and resides in the channel between the cheek piece and the flap with a forward sling end exposed through the open rearward end of the channel. In the deployed state the forward sling end reaches from the butt of the stock to the front gun portion to a point forward of the center of mass of the long gun allowing the long gun to be conveniently carried.

In accordance with another aspect of the invention, there is provided a method for stowing and deploying a long gun sling. The method for stowing the sling includes steps of: attaching a cheek piece around the butt of a long gun, a flap attached along one side of the cheek piece, reaching under the cheek piece, and releaseably attached on an opposite side of the cheek piece, the flap forming a channel under the cheek piece; attaching a rearward sling end of the sling to the butt of the long gun; if the releaseably side of the flap is attached to the cheek piece, releasing the releaseably side of the flap from the cheek piece; folding the long gun sling into a multiple overlapping folded state; holding the folded sling under the cheek piece; folding the flap under the folded sling leaving a forward sling end reaching out from a rear of the flap sufficiently to be grasped; and attaching the releaseably side of the flap to the cheek piece to sandwich the folded sling between the flap and the cheek piece. The method for deploying the sling includes steps of: drawing the folded sling to the rear from the channel; and attaching the forward sling end to a front gun portion of the long gun ahead of a center of mass of the long gun.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

The sling system according to the present invention may be used with a rifle or shotgun, both referred to hereafter as a long gun.

Figure 1:
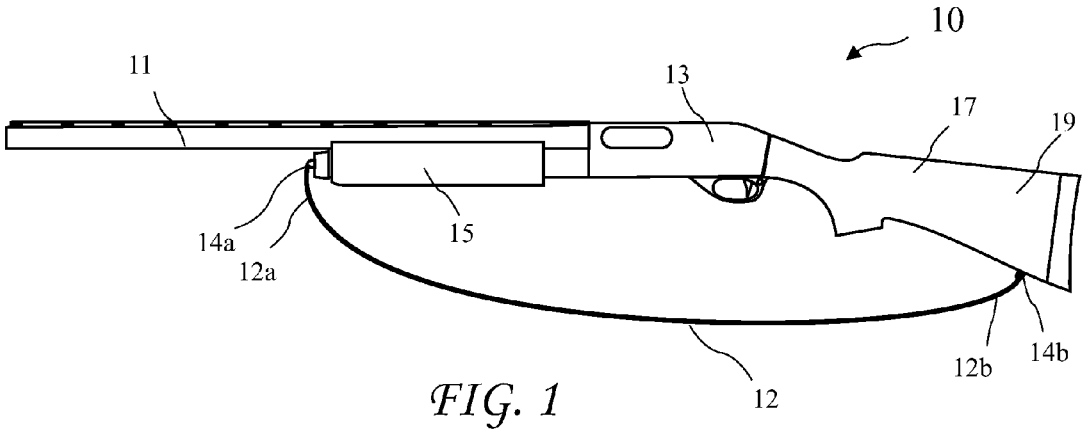
FIG. 1 (prior art)
FIG. 1 is a prior art shotgun and sling used by hunters in the field.

A prior art long gun (or shotgun as shown) 10 and sling 12 used by hunters in the field is shown in FIG. 1. The long gun 10 includes a barrel 11, receiver 13, forearm 15, and stock 17. A sling 12 is attached at a sling forward end 12*a* to a front sling post 14*a* and at a sling rearward end 12*b* to a rear sling post 14*b* residing at the butt 19 of the stock 17.

Figure 2A:
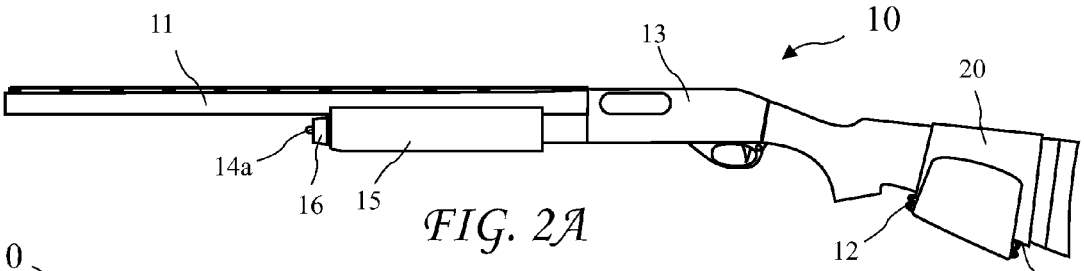
FIG. 2A is the shotgun with a sling system according to the present invention with the sling in a stowed position.
Figure 2B:
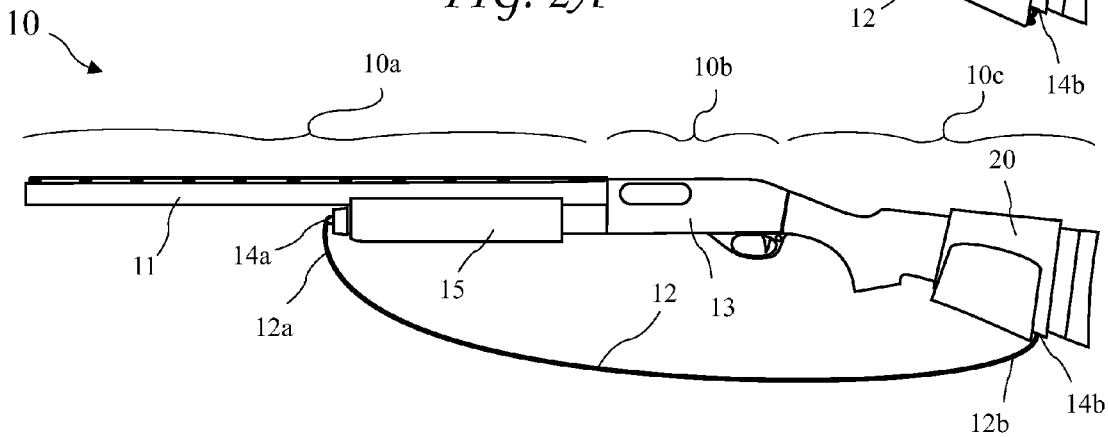
FIG. 2B is the shotgun with the sling system according to the present invention with the sling in a deployed position.

The long gun 10 with a sling system according to the present invention with the sling 12 in a stowed position is shown in FIG. 2*a* and with the sling 12 in a deployed position in FIG. 2B. The sling 12 is stowed in a cheek piece 20 residing over the butt 19. The front sling post 14*a* may be attached to a plug 16 residing at a forward end of a shell tube of a shotgun, or may be attached to a forearm of a rifle stock. The long gun 10 includes a front gun portion 10*a* including the barrel 11, a center gun portion 10*b* including the receiver 13, and a rear gun portion 10*c* including the butt 19. In order to comfortably carry the long gun 10 on a shoulder using the sling 12, the front sling post 14*a* must be forward of the center of mass of the long gun 10.

Figure 3:
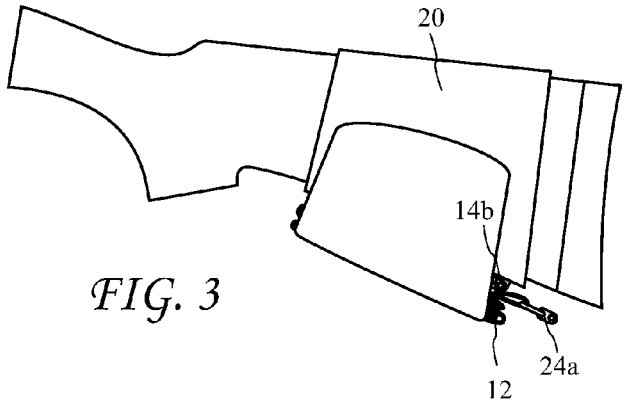
FIG. 3 is a detailed view of the sling system according to the present invention on the long gun stock with the sling in the stowed position.
Figure 4A:
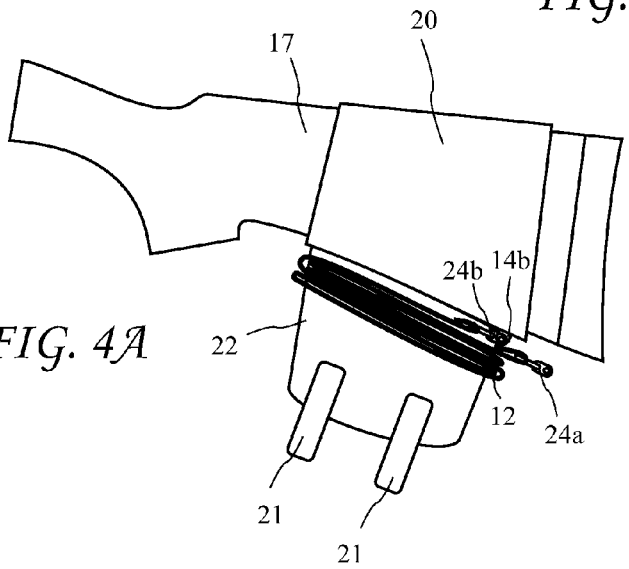
FIG. 4 is a detailed view of the sling system according to the present invention on the long gun stock with the sling in the stowed position with a flap open to show a folded sling.
Figure 4B:
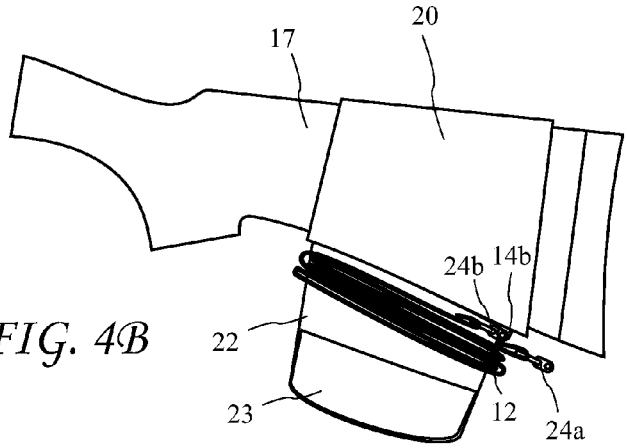

A detailed view of the sling system on the stock 17 with the sling 12 in the stowed position is shown in FIG. 3 and a detailed view of the sling system on the long gun stock 17 with the sling 12 in the stowed position with a flap 22 of the cheek piece 20 open to show the folded sling 12 is shown in FIG. 4. The flap 22 is attached along a far side 20*b* (see FIG. 5B) of the cheek piece 20, reaches under the cheek piece 20, and releaseably attached on a near side 20*a* of the cheek piece 20, forming a channel 27 (see FIG. 5B) under the cheek piece 20. A forward sling swivel 24*a* is attached to the forward sling end 12*a* (see FIG. 1) and a rearward sling swivel 24*b* is attached to the rearward sling end 12*b*. The flap 22 is attachable to the near side 20*a* by a fastener which may be straps 21 or more preferably the cooperation of loop compatible material used to construct the cheek piece 20 and a panel of loop material 23 on the flap 22 providing hook and loop fastening. The sling 12 has a sling width Ws and the channel 27 has a channel width Wc, where Wc is at least as wide as Ws.

Figure 5A:
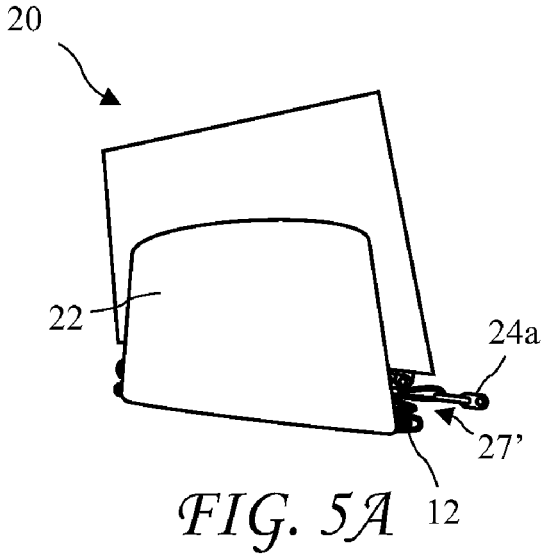
FIG. 5A is a side view of a cheek piece of the sling system according to the present invention with the sling in the stowed position.
Figure 5B:
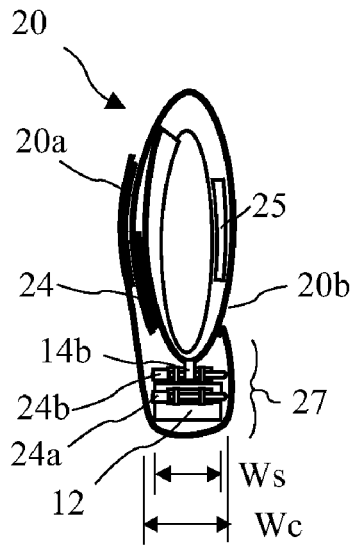
FIG. 5B is a rear view of the cheek piece of the sling system according to the present invention with the sling in the stowed position.
Figure 6A:
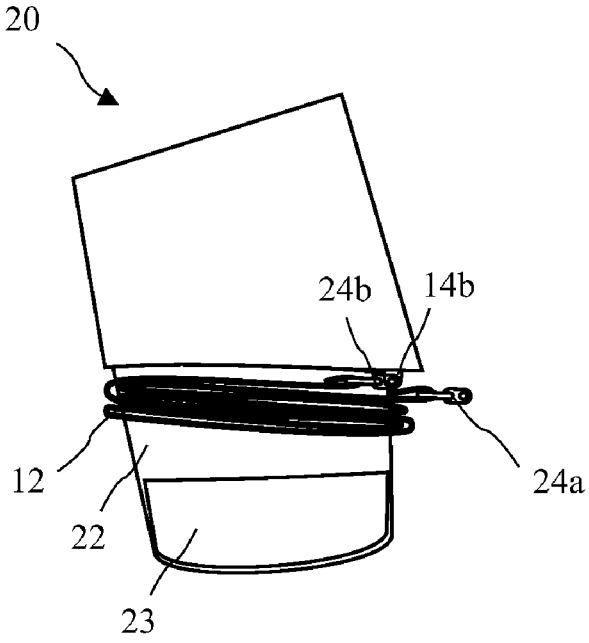
FIG. 6A is a side view of the cheek piece of the sling system according to the present invention with the sling in the stowed position with the flap open to show the folded sling.
Figure 6B:
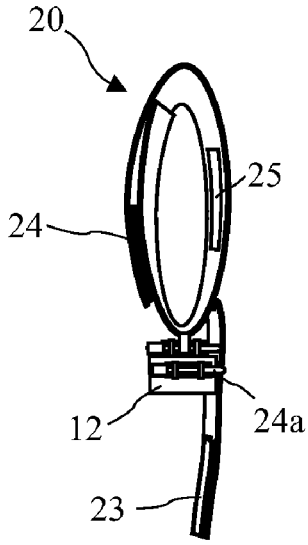
FIG. 6B is a rear view of the cheek piece of the sling system according to the present invention with the sling in the stowed position with the flap open to show the folded sling.

A side view of a cheek piece 20 of the sling system according to the present invention with the sling 12 in the stowed position is shown in FIG. 5A, a rear view of the cheek piece 20 with the sling 12 in the stowed position is shown in FIG. 5B, a side view of the cheek piece 20 with the sling 12 in the stowed position with the flap 22 open to show the folded sling is shown in FIG. 6A, and a rear view of the cheek piece 20 with the sling 12 in the stowed position with an open flap 22 and with the flap 22 open to show the folded sling is shown in FIG. 6B. The flap 22 and cheek piece 20 form the channel 27 holding the folded sling 12. The channel 27 has an open rearward end 27' and the forward sling end 12*a* preferably extends out through the open rearward end 27' to allow the hunter to easily grasp the forward sling end 12*a* and draw the sling 12 from the channel 27 to attach the forward sling end 12*a* to the front sling post 14*a* to deploy the sling.

The cheek piece 20 wraps around the butt 19 of the stock 17 and is held on the butt 19 by a fastener which may be straps or more preferably the cooperation of the loop compatible material used to construct the cheek piece 20 and a second panel of loop material 24 on the cheek piece 20 providing hook and loop fastening. A non-slip panel 25 is attached to an inner surface 20*a* of the cheek piece 20 to reduce or prevent movement of the cheek piece 20 on the stock 17. The non-slip panel 25 may, for example, be wet-suit like nylon backed neoprene material.

Figure 7A:
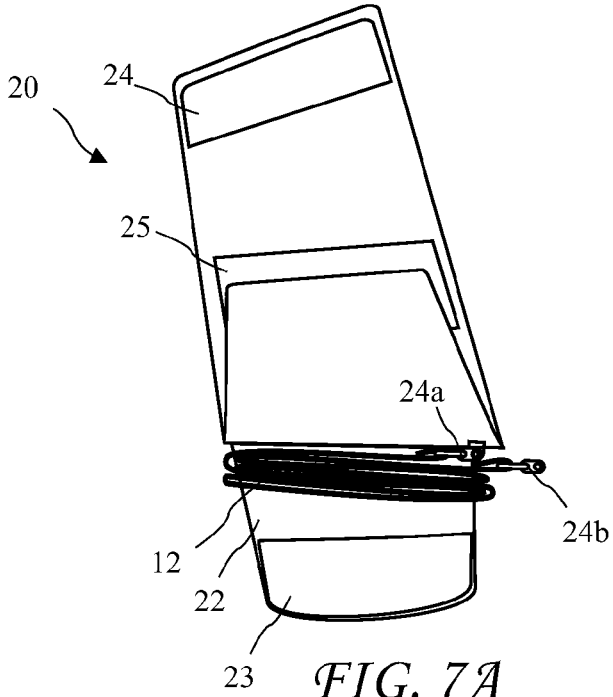
FIG. 7A is a side view of the cheek piece of the sling system according to the present invention with the sling in the stowed position with the flap open showing the folded sling and with the cheek piece partially unwrapped.
Figure 7B:
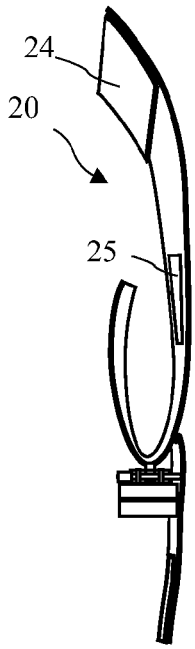
FIG. 7B is a rear view of the cheek piece of the sling system according to the present invention with the sling in the stowed position with an open flap and with the cheek piece partially unwrapped.
Figure 8A:
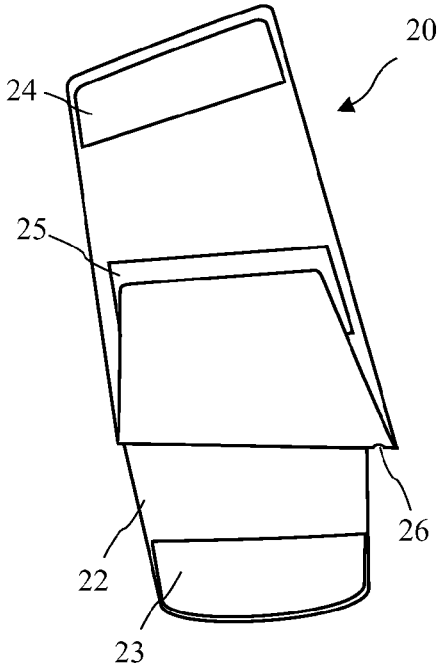
FIG. 8A is a side view of the cheek piece of the sling system according to the present invention with an open flap and with the open cheek piece without the sling and with the cheek piece partially unwrapped.
Figure 8B:
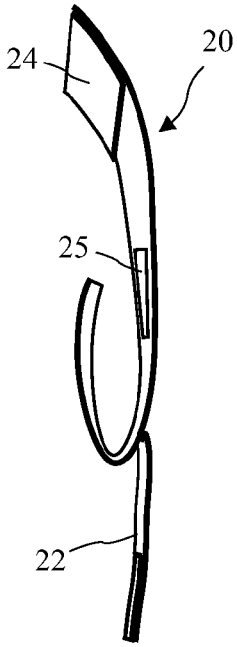
FIG. 8B is a rear view of the cheek piece of the sling system according to the present invention with the sling in the stowed position with an open flap without the sling and with the cheek piece partially unwrapped.

A side view of the cheek piece 20 partially unwrapped with the sling 12 in the stowed position with the flap 22 open showing the folded sling is shown in FIG. 7A, a rear view of the cheek piece 20 partially unwrapped with the sling 12 in the stowed position with the flap 22 open is shown in FIG. 7B, a side view of the cheek piece 20 partially unwrapped with the flap 22 open without the sling is shown in FIG. 8A, and a rear view of the cheek piece 20 partially unwrapped without the sling 12 with the flap open is shown in FIG. 8B.

Figure 9A:
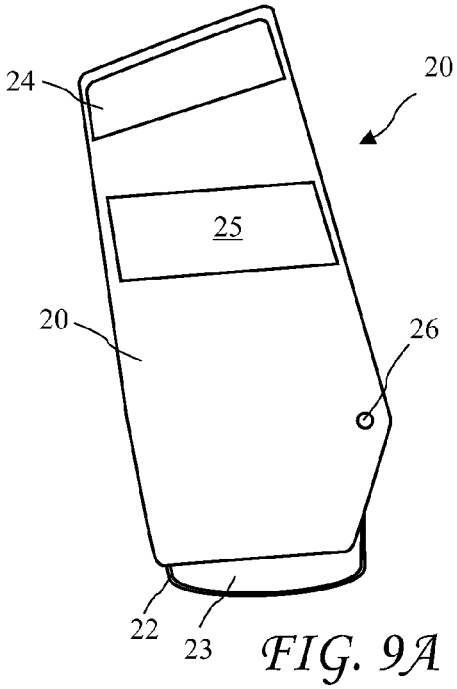
FIG. 9A is a side view of a completely unwrapped cheek piece according to the present invention.
Figure 9B:
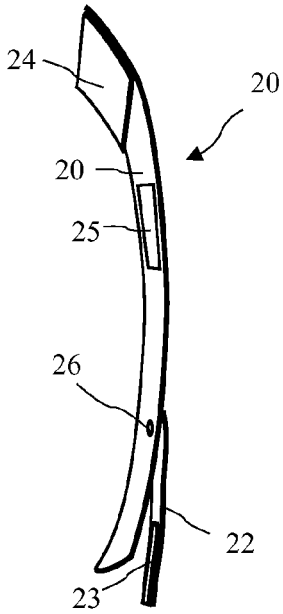
FIG. 9B is a rear view of the completely unwrapped cheek piece according to the present invention.

A side view of a completely unwrapped cheek piece 20 is shown in FIG. 9A and a rear view of the completely unwrapped cheek piece 20 is shown in FIG. 9B. The cheek piece 20 is thus made from a flat piece of material with the panel of loop material 24 attached for tightly wrapping the cheek piece 20 around the butt 19 of the stock 17, the flap 22 attached to creating the channel 27 to releaseably hold the stowed sling 12, and the non-slip panel 25 to reduce or prevent movement of the cheek piece 20 on the stock 17. A passage 26 is formed in the cheek piece 20 for the rear sling post 14*b* for quick positioning of the cheek piece 20 on the stock 17 and for further reducing or preventing movement of the cheek piece 20 on the stock 17, and the passage 26 may be a reinforced passage, for example, by stitching, to prevent or reduce tearing of the cheek piece 20. In another embodiment the rear edge of the cheek piece is notched to fit around the rear sling post 14*b*.

Figure 10:
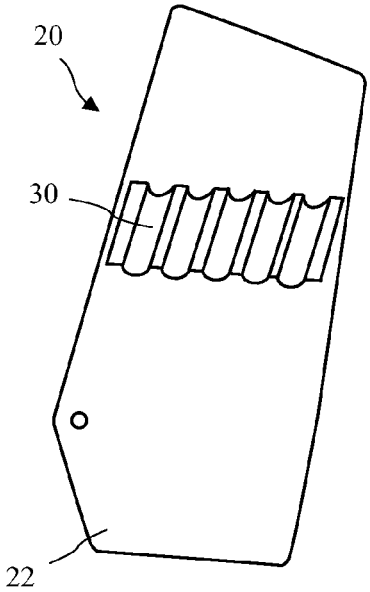
FIG. 10 is an opposite side view of a completely unwrapped cheek piece according to the present invention.

A far side 20*b* view of the completely unwrapped cheek piece 20 according to the present invention is shown in FIG. 10. Ammunition loops 30 are preferably formed on the far side 20*b* (opposite a right handed hunter's face) for carrying rounds of ammunition. The ammunition loops 30 are preferably configured to hold five rounds of shotgun ammunition, a common shotgun ammunition box size.

Figure 11:
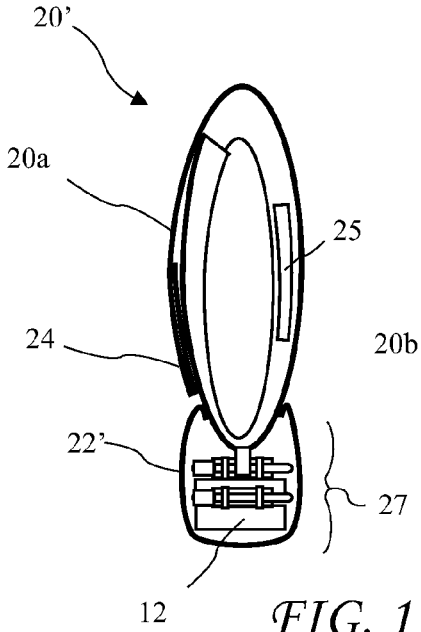
FIG. 11 is a second embodiment of the cheek piece according to the present invention with a fixed flap for storing the sling in the stowed position.

A second embodiment of the cheek piece 20' according to the present invention with a fixed flap 22' for storing the sling 12 is shown in FIG. 11. The fixed flap 22' is attached along both sides to the cheek piece 20' for storing the sling in the stowed position.

A preferred material for the cheek piece 20 comprises a jersey material on an inside face against the stock 17, an approximately 2.5 mil neoprene layer, and a loop compatible material on the outside surface for cooperation with the panels of loop material 23 and 24. Another embodiment of the cheek piece 20 comprises mostly nylon with only a portion of the cheek piece 20 made from a stretch material, for example, with stretch material adjacent to the panel of loop material 24 for tightly wrapping the cheek piece 20 around the butt 19 of the stock 17.

While the invention herein disclosed has been described by means of specific embodiments and applications thereof, numerous modifications and variations could be made thereto by those skilled in the art without departing from the scope of the invention set forth in the claims.

I claim:

1. A long gun and sling system comprising:

a long gun having a front gun portion including a barrel, a center gun portion including a receiver, and a rear gun portion including a butt formed by a stock of the long gun;

a cheek piece wrapping around a portion of the butt of the stock in intimate contact with the butt of the stock;

a flap attached along a first side of the cheek piece, reaching under the cheek piece, and attached on an opposite side of the cheek piece, the flap forming an elongated channel extending the length of the flap under the cheek piece;

a sling having a rearward sling end of the sling attached under the butt of the stock and being folded multiple overlapping sides, the sling residing lengthwise in the elongated channel under the stock and between the cheek piece and the flap, the sling being capable of taking a deployed state wherein a forward sling end of the sling reaches from the butt of the stock to the front gun portion to a point forward of the center of mass of the long gun.

2. The long gun and sling system of claim 1, wherein the channel has an open rearward end and the forward sling end is exposed through the open rearward end of the channel.

3. The long gun and sling system of claim 1, wherein the cheek piece comprises a stretchable fabric.

4. The long gun and sling system of claim 3, wherein the cheek piece is wrapped around the butt of the long gun and includes a fastener for tightening around the butt of the long gun.

5. The long gun and sling system of claim 4, wherein the cheek piece is wrapped around the butt of the long gun and includes overlapping portions having hook and loop fastening material for tightly fastening around the butt of the long gun.

6. The long gun and sling system of claim 1, wherein the flap comprises a stretchable fabric.

7. The long gun and sling system of claim 1, wherein the flap is releaseably attached on the opposite side using fastening straps.

8. The long gun and sling system of claim 6, wherein the flap is releaseably attached on the opposite side using hook and loop fastening material.

9. The long gun and sling system of claim 1, further including ammunition loops on the first side for receiving rounds of ammunition.

10. The long gun and sling system of claim 9, wherein the ammunition loops comprise five ammunition loops for receiving five rounds of shot gun ammunition.

11. The long gun and sling system of claim 1, wherein:

the rearward sling end is attached to a rear sling post and the forward sling end is attachable to a front sling post; and the channel resides ahead of the rear sling post.

12. The long gun and sling system of claim 11, wherein the sling includes sling swivels at both ends and the sling is attached to the sling posts by the sling swivels.

13. The long gun and sling system of claim 1, wherein the cheek piece includes a rubber panel on an interior surface residing against the stock to resist slippage of the cheek piece on the stock.

14. The long gun and sling system of claim 1, wherein the flap is permanently attached along a first side of the cheek piece, reaching under the cheek piece, and is releaseably attached on an opposite side of the cheek piece.

15. The long gun and sling system of claim 14, wherein the flap is releaseably attached to the opposite side of the cheek piece using hook and loop material.

16. The long gun and sling system of claim 1, wherein the flap is permanently attached along both sides of the cheek piece.

17. The long gun and sling system of claim 1, wherein the bottom rear of the cheek piece is notched to fit around a rear sling post attached to the butt of the stock.

18. A long gun and sling system comprising:

a long gun having a front gun portion including a barrel, a center gun portion including a receiver, and a rear gun portion including a butt formed by a stock of the long gun;

a cheek piece wrapped around a portion of the butt of the long gun in closed perimeter intimate contact around the butt of the long gun;

a flap attached along a first side of the cheek piece, reaching under the cheek piece, and attached on an opposite side of the cheek piece, the flap forming an elongated channel extending the length of the flap under the cheek piece, the channel having an open rearward end, the channel having a generally constant cross-section over the length of the flap, a channel width We wider than a sling as wide as the width Ws of a sling, and a volume sufficient to hold the sling when the sling is folded to about the same length as the channel;

the sling having a rearward sling end of the sling attached to the butt of the stock, the sling being folded multiple overlapping sides, the sling residing lengthwise in the elongated channel under the stock and between the cheek piece and the flap with a forward sling end exposed through the open rearward end of the channel, the sling being capable of taking a deployed state wherein a forward sling end of the sling reaches from the butt of the stock to the front gun portion to a point forward of the center of mass of the long gun.

19. A method for stowing and deploying a long gun sling, the method comprising:

the stowing the sling comprising the steps of:

attaching a cheek piece around the butt of a long gun, a flap attached along one side of the cheek piece, reaching under the cheek piece, and releaseably attached on an opposite side of the cheek piece, the flap forming a channel under the cheek piece;

attaching a rearward sling end of the sling to the butt of the long gun;

if the releasable side of the flap is attached to the cheek piece, releasing the releasable side of the flap from the cheek piece;

folding the long gun sling into a multiple overlapping folded state;

holding the folded sling under the cheek piece;

folding the flap under the folded sling leaving a forward sling end reaching out from a rear of the flap sufficiently to be grasped; and attaching the releasable side of the flap to the cheek piece to sandwich the folded sling between the flap and the cheek piece; and the deploying the sling comprising the steps of:

drawing the folded sling to the rear from the channel; and attaching the forward sling end to a front gun portion of the long gun ahead of a center of mass of the long gun.

* * * * *